US007272957B2

(12) United States Patent
Morita

(10) Patent No.: US 7,272,957 B2
(45) Date of Patent: Sep. 25, 2007

(54) PILE KNITTING METHOD BY WEFT KNITTING MACHINE

(75) Inventor: Toshiaki Morita, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/594,890

(22) PCT Filed: Mar. 29, 2005

(86) PCT No.: PCT/JP2005/005961

§ 371 (c)(1),
(2), (4) Date: Sep. 29, 2006

(87) PCT Pub. No.: WO2005/095697

PCT Pub. Date: Oct. 13, 2005

(65) Prior Publication Data

US 2007/0180865 A1 Aug. 9, 2007

(30) Foreign Application Priority Data

Mar. 31, 2004 (JP) ..... 2004-103184

(51) Int. Cl.
*D04B 7/04* (2006.01)

(52) U.S. Cl. ..... 66/64; 66/191; 66/194

(58) Field of Classification Search ..... 66/190, 66/191, 194, 64, 71
See application file for complete search history.

(56) References Cited

U.S. PATENT DOCUMENTS 5,937,673 A * 8/1999 Shima ..... 66/120
6,018,966 A 2/2000 Shima
6,047,569 A * 4/2000 Shima ..... 66/64
6,510,712 B2 1/2003 Baseggio
6,612,135 B1 9/2003 Pinzauti
2002/0112509 A1 8/2002 Baseggio et al.

FOREIGN PATENT DOCUMENTS

JP 34-4254 3/1959
JP 10-325057 12/1998
JP 2917146 3/1999
JP 2002-294541 A 10/2002

* cited by examiner

*Primary Examiner*—Danny Worrell
(74) *Attorney, Agent, or Firm*—Harness, Dickey, Pierce, P.L.C.

(57) ABSTRACT

A pile knitting method by a weft knitting machine is provided in which a compound needle can be used to form a pile stitch and simultaneously hold other stitches. After a hook of a needle body receives a fastening yarn fed thereto, a carriage brings together a yarn feeder for feeding a pile yarn and the hook receives the pile yarn. On a front needle bed, the needle body is raised to a tuck position in a state where an old loop is set on a tongue of a slider. The hook of the needle body holds therein the fastening yarn. When the pile yarn is fed to the hook from the yarn feeder, the hook holds therein the fastening yarn and the pile yarn. The pile yarn is set also on a tongue of a slider on a rear needle bed, which tongue has been already raised and advanced into a needle bed gap.

8 Claims, 6 Drawing Sheets

PILE KNITTING METHOD BY WEFT KNITTING MACHINE

PRIORITY STATEMENT

This application is the national phase under 35 U.S.C. § 371 of PCT International Application No. PCT/JP2005/005961 which has an International filing date of Mar. 29, 2005, which designated the United States of America and which claims priority on Japanese Patent Application number P2004-103184 filed Mar. 31, 2004, the entire contents of which are hereby incorporated herein by reference.

TECHNICAL FIELD

The present invention generally relates to a pile knitting method by a weft knitting machine. For example, it may relate to one using a fastening yarn and a pile yarn, in which a knitted loop of the pile yarn can be made larger than a knitted loop of the fastening yarn.

BACKGROUND ART

Conventionally, it has been known that a pile can be knitted by a weft knitting machine having opposed front needle bed and rear needle bed between which a needle bed gap lies. For example, a knitting machine has been disclosed (refer to Japanese Unexamined Utility Model Publication JP-Y1 34-4254 (1959), for example) such that an auxiliary needle bed having a pile pull-out needle attached thereto is provided on an upside of one needle bed and at the time of knitting a pile fabric, a pile yarn is held on the pile pull-out needle of the auxiliary needle bed and then released from the pile pull-out needle whereby a pile loop can be formed.

Further, there is also disclosed a technique that slider members for pile knitting, instead of knitting needles, are attached to needle grooves at positions for forming pile loops on the opposed needle beds in a widely-used weft knitting machine. At the time of knitting a pile, these slider members are advanced to a needle bed gap where the pile yarn is delivered, and the pile yarn is then cut off by a cutting portion formed on a rim of the slider member so that a cut pile is formed (refer to U.S. Pat. No. 6,612,135, for example).

In the JP-Y1 34-4254 and U.S. Pat. No. 6,612,135, it is necessary to provide a member or other components for pile knitting only. An applicant of the present application has disclosed, however, a method in which a pile loop can be formed without such a member (refer to Japanese Examined Patent Publication JP-B2 2917146, for example). In this pile stitch forming method, a compound needle having a slider including two elastic plates each having a tongue at a top end thereof, is attached as a knitting needle to each of needle beds opposing head to head between which a needle gap lies. A hook of needle body of this compound needle is slidably pinched by the elastic plates, and is able to be opened and closed by the tongue.

A knitting needle holding a knitted loop formed of a fastening yarn and a pile yarn is raised and advanced to a knit position and subsequently, receives a new fastening yarn by the hook. When the knitting needle is lowered and retracted to pull the fastening yarn into an old loop already formed, a slider is kept at a raised and advanced position above the needle bed gap so that the old loop is not knocked over by going beyond a top end of the slider. While the old loop is held on the tongue of the slider, the fastening yarn is pulled into the old loop.

Subsequently, the knitting needle is raised and then, a pile yarn is fed to a hook of the knitting needle and a hook of a knitting needle which has been raised and advanced from an opposed needle bed toward the needle bed gap. Both of the knitting needles are then lowered and retracted from the knitting needle bed. The fastening yarn and the pile yarn are aligned together and put through the old loop by one knitting needle while the other knitting needle holds only a pile stitch formed of the pile yarn. Next, only the knitting needle holding the pile stitch is moved up and down to release the pile stitch from the knitting needle to thereby form a pile loop in a fabric being knitted by the knitting needle on the opposed needle bed.

The slider of the compound needle used in the pile stitch forming method of JP-B2 2917146 can be advanced farther to the needle bed gap than the hook of the needle body can. Such a compound needle has been developed for the purpose of effecting transfer between compound needles on opposed needle beds by use of a top end portion of a slider called a tongue or nose (refer to Japanese Unexamined Patent Publications JP-A 10-325057 (1998) and JP-A 2002-294541).

In order to use those forming methods disclosed in the JP-Y1 34-4254 and U.S. Pat. No. 6,612,135 in a case where the pile knitting is performed by the weft knitting machine, it is necessary to provide a member for pile knitting only. In the prior art disclosed in JP-Y1 34-4254, it is necessary to also provide an auxiliary needle bed to which the member for pile knitting only is attached, with the result that the knitting machine becomes consequently complex and expensive. In the prior art disclosed in U.S. Pat. No. 6,612,135, a cut pile can be formed, but it is necessary to mount a slider member, instead of a knitting needle, in a needle groove on a needle bed. In this case, it is possible to selectively perform one of normal knitting and pile knitting while both thereof cannot be performed at the same time. As a result, only a single function is provided.

In the pile stitch forming method disclosed in JP-B2 2917146, it is possible to use the member as a knitting needle in normal knitting for fabric. When the tongue of the slider is used, it is possible to perform the pile knitting by use of the compound needle which also allows transfer and knitted-loop holding. Accordingly, a pile loop can be freely formed in a fabric, and it is possible to knit various fabrics.

However, there is a need to perform operations of raising the slider so as to be advanced to the needle bed gap and closing the hook by the tongue when releasing the pile stitch from the hook of the compound needle holding only the pile stitch. In other words, not only the needle body of the compound needle, but also the slider needs to be used for forming the pile stitch. As a consequence, the compound needle for receiving the pile yarn must be used only for forming the pile stitch, and is thus not usable in such an application as holding other stitches.

In particular, in a case where fabrics are knitted respectively by front and rear needle beds and both ends of these fabrics are then connected to each other to form a tubular fabric, it is difficult to use the knitting needles on the needle beds opposed to each other between which the needle bed gap lies, for forming the pile stitch because these knitting needles are used for forming the respective fabric. If the pile stitch can be formed while the fabrics are held, it becomes possible to easily knit the tubular pile.

SUMMARY

An object of an embodiment of the invention is to provide a pile knitting method by a weft knitting machine in which a compound needle can be used to form a pile stitch and simultaneously hold other stitches.

An embodiment of the invention provides a method of knitting pile fabric by a weft knitting machine having a compound needle whose slider is capable of advancing farther to a needle bed gap than a hook of a needle body which compound needle is provided on at least one of opposed front and rear needle beds between which the needle bed gap lies, the method comprising feeding a fastening yarn and a pile yarn to a knitting needle on a needle bed opposed to a needle bed provided with the compound needle across the needle bed gap, the method comprising:

when the pile yarn is fed to the knitting needle, setting the pile yarn also on a tongue of a slider of the compound needle;

when fastening yarn is fed to the knitting needle not feeding the fastening yarn to the compound needle;

forming stitches of the pile yarn and the fastening yarn so that only a pile stitch is held on the tongue of the slider of the compound needle; and forming a pile loop in a fabric being knitted by the knitting needle by retracting the slider of the compound needle from the needle bed gap and releasing the pile stitch from the tongue of the slider.

Further, in an embodiment of the invention, it is preferable that each of the front and rear needle beds is provided with a compound needle as a knitting needle, and that in the case of forming pile stitches at least in a part of a fabric being knitted on one needle bed, the pile stitches are formed using the tongue of the slider of the compound needle on another needle bed and the compound needle on the one needle bed while the hook is retracted from the needle bed gap and the slider of the compound needle of the other needle bed is advanced to the needle bed gap in a state where a fabric being knitted on the other needle bed is held on the hook of the compound needle on the other needle bed, and that in the case of forming the pile stitch at least in a part of a fabric being knitted on the other needle bed, the pile stitches are formed using the tongue of the slider of the compound needle on the one needle bed and the compound needle on the other needle bed while the hook is retracted from the needle bed gap and the slider of the compound needle on the one needle bed is advanced to the needle bed gap in a state where a fabric being knitted on the one needle bed is held on the hook of the compound needle on the one needle bed.

Further, in an embodiment of the invention, it is preferable that the method comprises, in the case of forming pile stitches in the fabric being knitted on the needle bed provided with the knitting needle, advancing the hook of the knitting needle and feeding to the hook of the knitting needle the fastening yarn for a new loop, in a state where an old loop formed of the fastening yarn and the pile yarn is held on the knitting needle;

retracting the hook of the knitting needle from the needle bed gap and pulling in the fastening yarn in a range where the old loop held on the knitting needle is not knocked over;

advancing the hook of the knitting needle to the needle bed and feeding the pile yarn to the hook of the knitting needle and the tongue of the slider of the compound needle on a needle bed opposed to the needle bed in a state where only the fastening yarn is held on the hook;

knocking over the old loop by retracting the hook of the knitting needle from the needle bed gap so that the fastening yarn and pile yarn of the new loop are pulled by the hook into the old loop held on the knitting needle; and forming a pile loop by retracting the slider of the knitting needle from the needle bed gap and releasing the pile stitch set on the tongue of the slider.

Further, in an embodiment of the invention, it is preferable that the pile loop formed by releasing the pile stitch from the tongue of the slider is pressed by a loop presser into the needle bed gap.

BRIEF DESCRIPTION OF DRAWINGS

Objects, features, and advantages of the invention will be more explicit from the following detailed description of example embodiments taken with reference to the drawings wherein.

DETAILED DESCRIPTION OF THE EXAMPLE EMBODIMENTS

Figure 1:
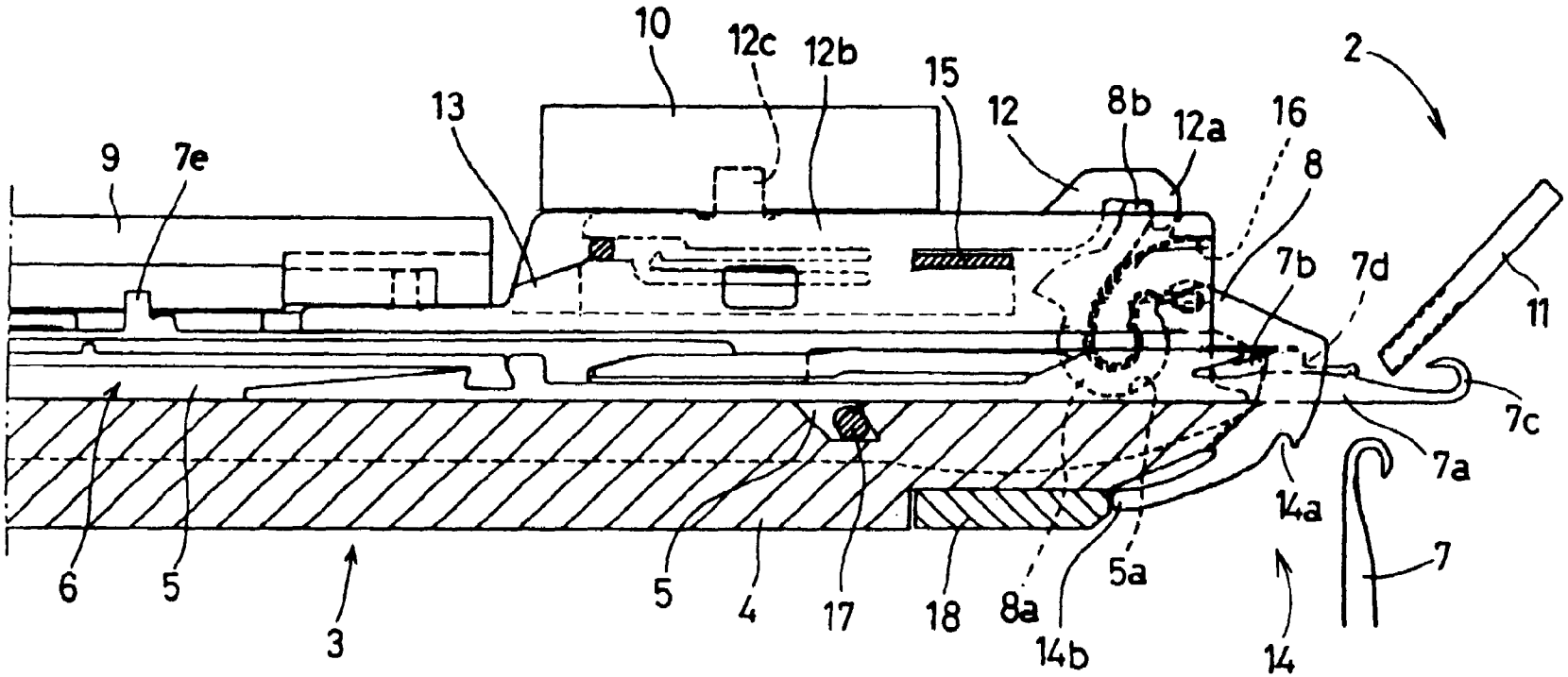
FIG. 1 is a sectional side view showing a configuration of a main part of a weft knitting machine 1 which is used in a pile knitting method according to one embodiment of the invention.

Now referring to the drawings, example embodiments of the invention are described below.

FIG. 1 shows a configuration of a main part of a weft knitting machine 1 which is used in a pile knitting method according to one embodiment of the invention. The weft knitting machine 1 has front and rear needle beds which are opposed to each other across a needle bed gap 2. In the figure, one needle bed 3 is shown while the other needle bed is omitted. The needle bed 3 is inclined with respect to the needle bed gap 2 so that one side of the needle bed 3 close to the needle bed gap 2 is high and a part of the needle bed 3 farther away from the needle bed gap 2 is lower. That is to say, the front and rear needle beds 3 between which the needle bed gap 2 lies are disposed in an inverted V-form. However, the one needle bed 3 is shown in a horizontal posture for the sake of convenience for explanation. A configuration of the one needle bed 3 is basically the same as that of the other needle bed.

In the needle bed 3, a large number of needle plates 5 are implanted respectively in a direction toward the needle bed gap 2, in a base 4 which is disposed so as to face the needle bed gap 2 serving as a fabric knitting area. A board thickness of the needle plate 5 is thin at an end portion thereof which is close to the needle bed gap 2. Between needle plates 5 are formed such needle grooves 6 that each has an expanding width on a portion close to the needle bed gap 2 in accordance with decrease of the board thickness of the needle plates 5. A knitting needle 7 is received in each of the needle grooves 6, and at the end portion having the expanded width of the needle groove a movable sinker 8 is received. The needle bed 3 is thus formed.

The knitting needle 7 is a compound needle having a needle body 7*a* and a slider 7*b* which can be independently moved. At a top end of the needle body 7*a* is formed a hook 7*c* while at a top end of the slider 7*b* is formed a tongue 7*d* having two separate elastic plates, a top end portion of which is provided with a step. The hook 7*c* of the needle body 7*a* is nipped by the tongue 7*d* of the slider 7*b* so as to be slidable. Such a compound needle is explained in detail in paragraphs and FIGS. 2-4 in drawings of JP-B2 2917146. It is also possible to use a compound needle as disclosed in JP-A 10-325057 and JP-A 2002-294541.

In the weft knitting machine 1, while a carriage is made to travel back and forth above the needle beds 3 along the needle bed gap 2, that is, perpendicularly to a paper sheet, the knitting needle 7 is selectively advanced to and retracted from the needle bed gap 2 so as to knit a fabric by interaction with the movable sinker 8. However, the carriage is omitted in figures while a knitting needle operating cam mechanism 9 for operating the knitting needle 7 and a sinker operating cam mechanism 10 for operating the movable sinker 8 are shown. The knitting needle operating cam mechanism 9 can operate the needle body 7*a* and the slider 7*b* selectively and separately.

In the needle bed gap 2, a knitting yarn is fed from a yarn feeder 11 to the knitting needle 7 so that a knitted loop can be formed. The knitting needle 7 is disposed side-by-side with the movable sinker 8 with respect to a width direction of each of the needle grooves 6. The needle body 7*a* is provided with a butt for driving the advancing and retracting displacement to/from the needle bed gap 2. The butt is positioned on a left side of the needle body 7*a* in the figure and therefore not shown in the figure. The slider 7*b* is provided with a butt 7*e* for driving the advancing and retracting displacement to/from the needle bed gap 2.

The needle plate 5 has at the end portion thereof close to the needle bed gap 2, a concave portion 5*a* about which the movable sinker 8 can be pivotally displaced. The movable sinker 8 has a base 8*a* which is borne and supported by the concave portion 5*a*, and a receiving portion 8*b* which is driven in response to the advancing and retracting displacement to/from the needle bed gap 2.

Inside each of the needle grooves 6 is received a sinker jack which can be linearly displaced to advance to and retract from the needle bed gap 2. The sinker jack 12 engages at an end portion 12*a* thereof with the receiving portion 8*b* of the movable sinker 8. The sinker jack 12 has a butt 12*c* at a position close to a base 12*b* which extends from the end portion 12*a* in a direction away from the needle bed gap 2. The butt 12*c* protrudes in a direction away from the base 4 of the needle bed 3, whereby the sinker jack 12 is subjected to action of the sinker operating cam mechanism 10.

In each of the needle grooves 6 is disposed a spacer 13 in a direction away from the base 4 of the needle bed 3 with respect to the knitting needle 7. The spacer 13 uses a bottom portion thereof to regulate the knitting needle 7 so as not to be separated from the base 4, and uses a side portion thereof to regulate the sinker jack 12 so as not to be shifted in the width direction of the needle groove 6. The movable sinker 8 has a top end portion 14 acting as a sinker in the needle bed gap 2 by pivotal displacement about the base 8*a*, which is converted from the advancing and retracting displacement given to the receiving portion 8*b*.

On the top end portion 14 is formed a knitting yarn receiving portion 14*a*. A metal band 15 penetrates the spacer 13 in each of the needle grooves 6 and the needle plate 5, in a direction along the needle bed gap 2, that is, a direction perpendicular to the paper sheet so that the spacer 13 and the needle plate 5 are fixed together by the metal band 15. The metal band 15 is inserted also into the sinker jack 12 to regulate the sinker jack 12 so as not to be separated from the needle groove 6 when slidably displaced.

The base 8*a* of the movable sinker 8 is provided with a wire spring 16 for biasing the movable sinker 8 in a clockwise direction of the figure. A wire 17 is used to fix the needle plate 5 and the base 4. At a position of a bottom portion of the base 4 close to the needle bed gap 2 is provided a stopper 18 for regulating the pivotal displacement of the movable sinker 8 attributable to bias caused by the wire spring 16 by abutment of a tip 14*b* of the top end portion 14 of the movable sinker 8 on the stopper.

FIGS. 2 to 11 respectively show the knitting needle 7 in operating states at the time of knitting a tubular pile fabric by use of the front and rear needle beds 3, when seen schematically in sectional side views of a vicinity of the needle bed gap 2. Note that for the sake of convenience for explanation, related components on the needle bed 3 on a back side with respect to the needle bed 3 on a front side in an anterior view of the weft knitting machine 1 are denoted by reference numerals obtained by adding 100 to reference numerals of corresponding components of the needle bed 3 on the front side.

Further, in the knitting needle knitting cam mechanism 9 mounted on the carriage for making the knitting needle 7 conduct the knitting operation, one knitting cam system is provided for each of the front and rear needle beds 3 and 103. It is a matter of course that a plurality of systems can be provided. If the plurality of systems are provided, one-time movement of the carriage can achieve operations for a plurality of courses, thereby allowing reduction in number of movement of the carriage. Further, a yarn feeder 11*a* for fastening yarn and a yarn feeder 11*b* for pile yarn are supposed to stand by on one side in a longitudinal direction of the needle bed 3.

Figure 2:
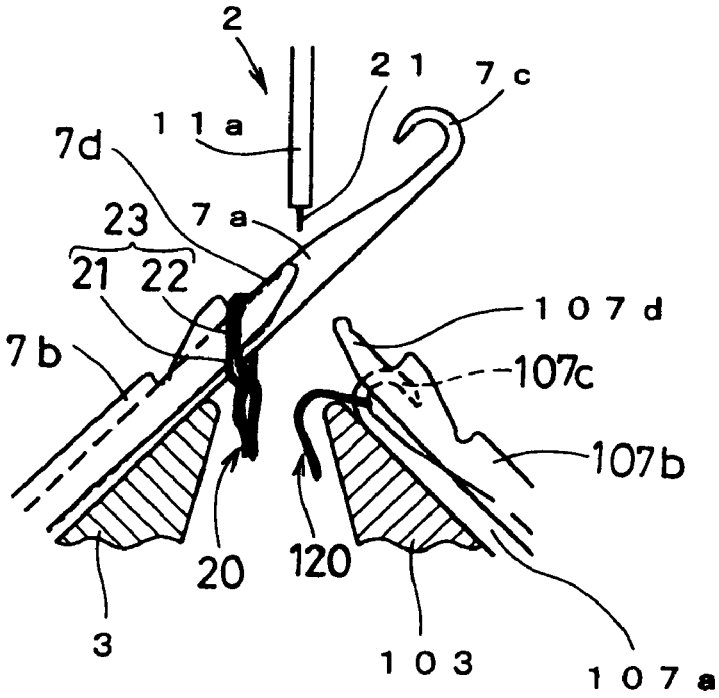
FIG. 2 is a sectional side view schematically showing a vicinity of a needle bed gap in a state of starting formation of a pile stitch into a fabric 20 being knitted on a front needle bed 3 as a first course in the pile knitting method according to one embodiment of the invention.

FIG. 2 shows a state of starting formation of a pile stitch into a fabric 20 being knitted on the front needle bed 3 as a first course. A fabric 120 being knitted on the rear needle bed 103 is held by a hook 107*c* of a needle body 107*a* of a knitting needle 107. The carriage brings together the yarn feeder 11*a* for feeding a fastening yarn 21. On the front needle bed 3, in a state where an old loop 23 formed of the fastening yarn 21 and pile yarn 22 is held on the tongue 7*d* of the slider 7*b*, the needle body 7*a* is raised and advanced to the needle bed gap 2 so that the hook 7*c* receives the fastening yarn 21 fed from the yarn feeder 11*a*.

Figure 3:
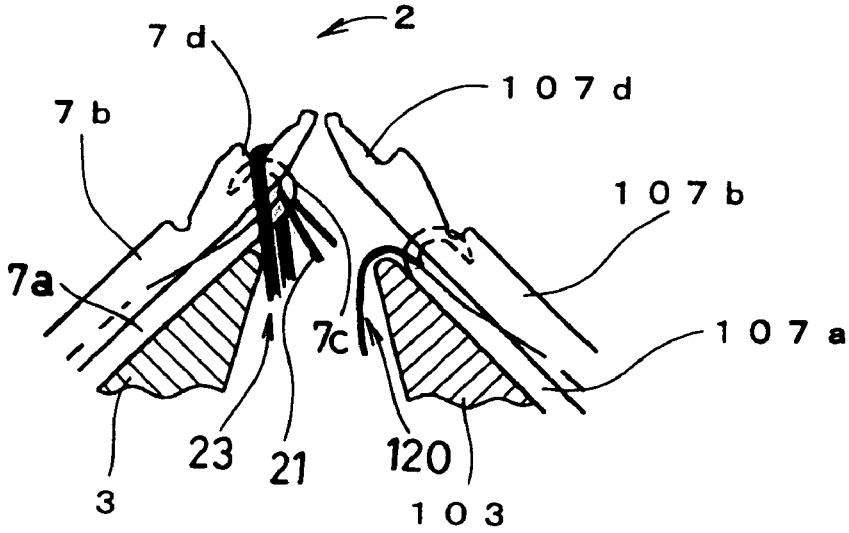
FIG. 3 is a sectional side view schematically showing the vicinity of the needle bed gap where a fastening yarn 21 is being pulled in, following FIG. 2.

FIG. 3 shows a state of lowering and retracting the needle body 7*a* from the needle bed gap 2 whereby a fastening yarn 21 is being pulled in while the slider 7*b* remains in the current state, following FIG. 2. A stitch density of stitch cams provided on the knitting cam system of the knitting operating cam mechanism 9 is set, for example, so that a minimum amount of the fastening yarn 21 is pulled in, whereby the knock-over is prevented even when the slider 7*b* is located at a position higher than that of the hook 7*a*. On the rear needle bed 103, a slider 107*b* is raised and advanced to the needle bed gap 2. Whether or not the slider 107*b* is raised and advanced at this timing is dependent on the knitting cam mounted on the carriage. The timing of raising and advancing the rear slider 107*b* to the needle bed gap 2 is not necessarily limited to the timing in FIG. 3, and may be at any timing that the raising and advancing displacement ends before a yarn feeding position.

As described above, both of the yarn feeders 11*a* and 11*b* are disposed on the same side and therefore, the carriage needs to move for the second course in a reverse direction to that for the first course. In addition, it is necessary to set an empty course in which the knitting needles 7 and 107 are not made to operate.

Figure 4:
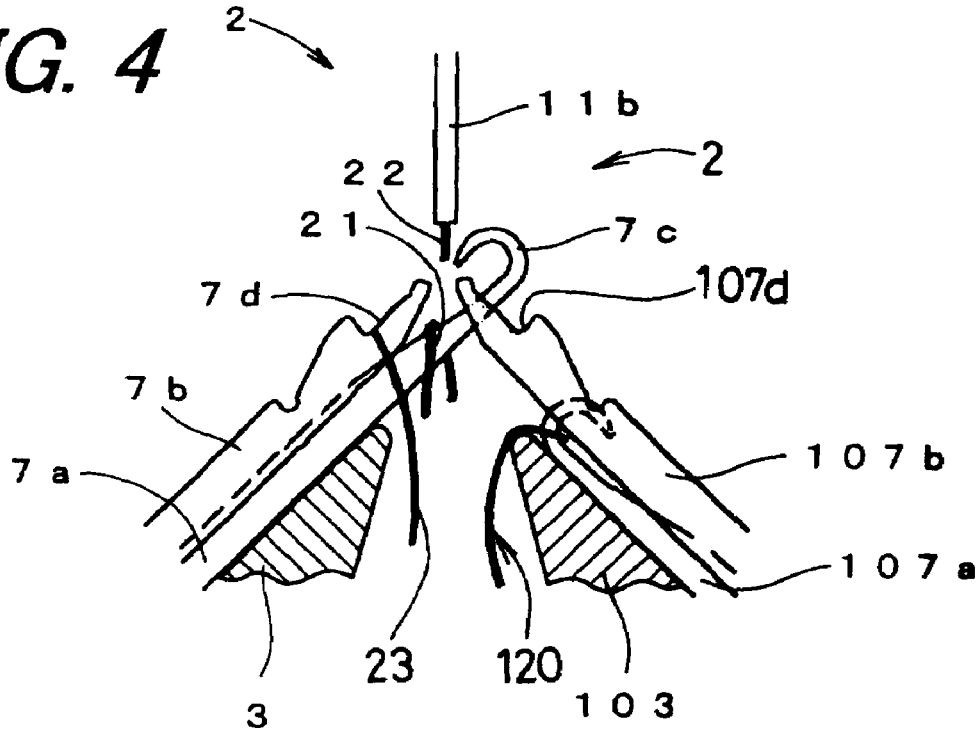
FIG. 4 is a sectional side view schematically showing the vicinity of the needle bed gap in a state where a hook 7*c* receives a pile yarn 22 as a third course in the pile knitting method according to one embodiment of the invention.

FIG. 4 shows a state of making the carriage move in the same direction as that for the first course and bringing together the yarn feeder 11*b* for feeding the pile yarn 22, whereby the hook 7*c* receives the pile yarn 22. On the front needle bed 3, in a state where the old loop 23 is held on the tongue 7*d* of the slider 7*b*, the needle body 7*a* is raised to a tuck position. The hook 7*d* of the needle body 7*a* holds therein the fastening yarn 21. When the pile yarn 22 is fed from the yarn feeder 11*b* to the hook 7*c*, the hook 7*c* holds therein the fastening yarn 21 and the pile yarn 22. The pile yarn 22 is set also on a tongue 107*d* of the slider 107*b* on the rear needle bed 103, which has already been raised and advanced into the needle bed gap 2.

Figure 5:
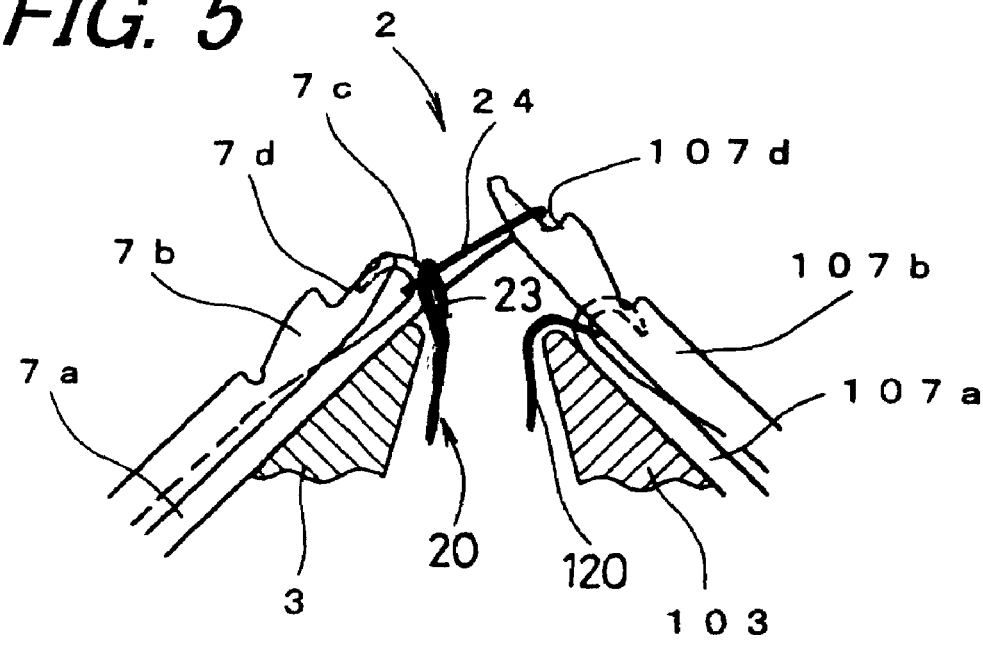
FIG. 5 is a sectional side view schematically showing the vicinity of the needle bed gap in a state where an old loop 23 is knocked over, following FIG. 4.

Following FIG. 4, FIG. 5 shows a state of lowering the needle body 7*a* and the slider 7*b* together to pull in on the front needle bed 3, whereby the old loop 23 held on the tongue 7*d* of the slider 7*b* is knocked over. The pile yarn 22 set on the tongue 107*d* of the slider 107*b* on the rear needle bed 103 is pulled out to form a pile stitch 24. The fabric 20 is held by the hook 7*c*.

Figure 6:
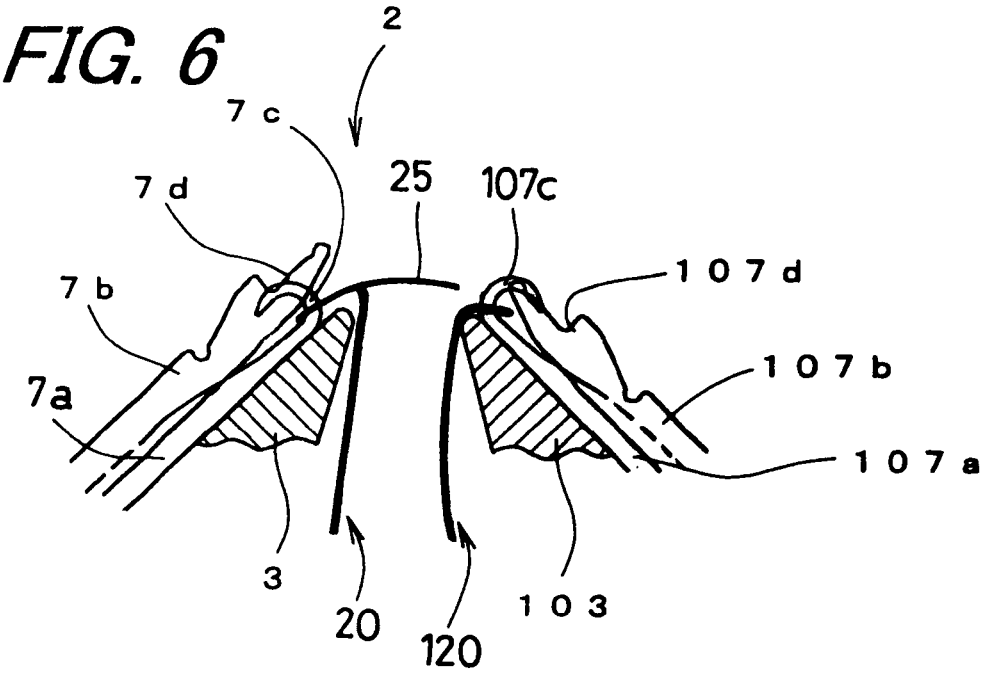
FIG. 6 is a sectional side view schematically showing the vicinity of the needle bed gap in a state where a slider 107*b* on a rear needle bed 103 is lowered and retracted from a needle bed gap 2 so that a pile stitch 24 set on a tongue 107*d* is released at a beginning of a fourth course in the pile knitting method according to one embodiment of the invention.

FIG. 6 shows a state of lowering and retracting the slider 107*b* on the rear needle bed 103 from the needle bed gap 2 at a beginning of a fourth course, whereby the pile stitch 24 set on the tongue 107*d* is released. The pile stitch 24 becomes a pile loop 25 which protrudes from a surface of the fabric 20 held on the front needle bed 3. It is preferable that the carriage be provided with a loop presser such as a stitch presser, by which this pile loop 25 is pressed into the needle bed gap 2. Note that a detail description of the stitch presser is disclosed in Japanese Examined Patent Publication JP-B2 3-66415 (1991), for example. Further, the carriage brings together the yarn feeder 11*a* for feeding the fastening yarn 21.

Figure 7:
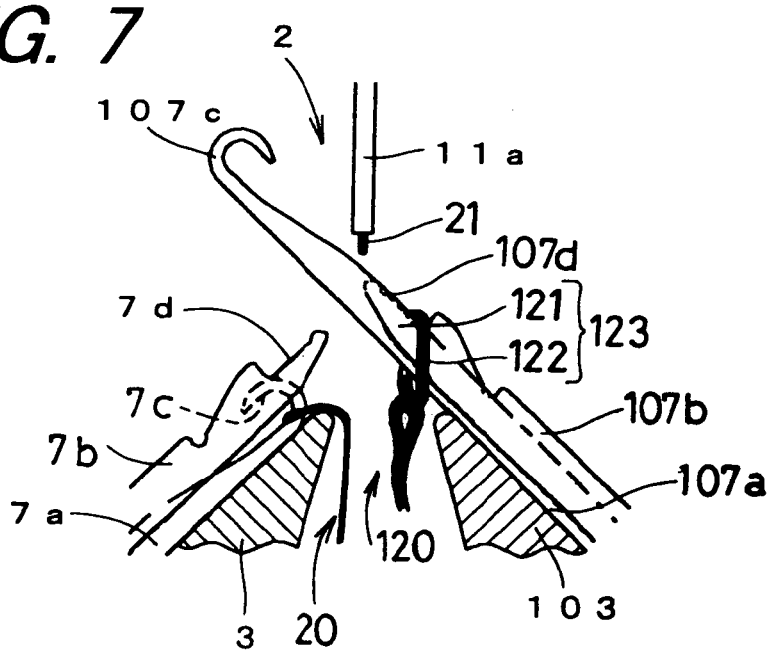
FIG. 7 is a sectional side view schematically showing the vicinity of the needle bed gap in a state of starting formation of a pile stitch into a fabric 120 being knitted on the rear needle bed 103, following FIG. 6.

Following FIG. 6, FIG. 7 shows a state of starting formation of a pile stitch into a fabric 120 being knitted on the rear needle bed 103. The fabric 20 being knitted on the front needle bed 3 is held by the hook 7*c* of the needle body 7*a* of the knitting needle 7. On the rear needle bed 3, in a state where an old loop 123 formed of the fastening yarn 21 and the pile yarn 22 is held on the tongue 107*d* of the slider 107*b*, the needle body 107*a* is raised and advanced to the needle bed gap 2 so that the hook 107*c* receives the fastening yarn 21 fed from the yarn feeder 11*a*.

Figure 8:
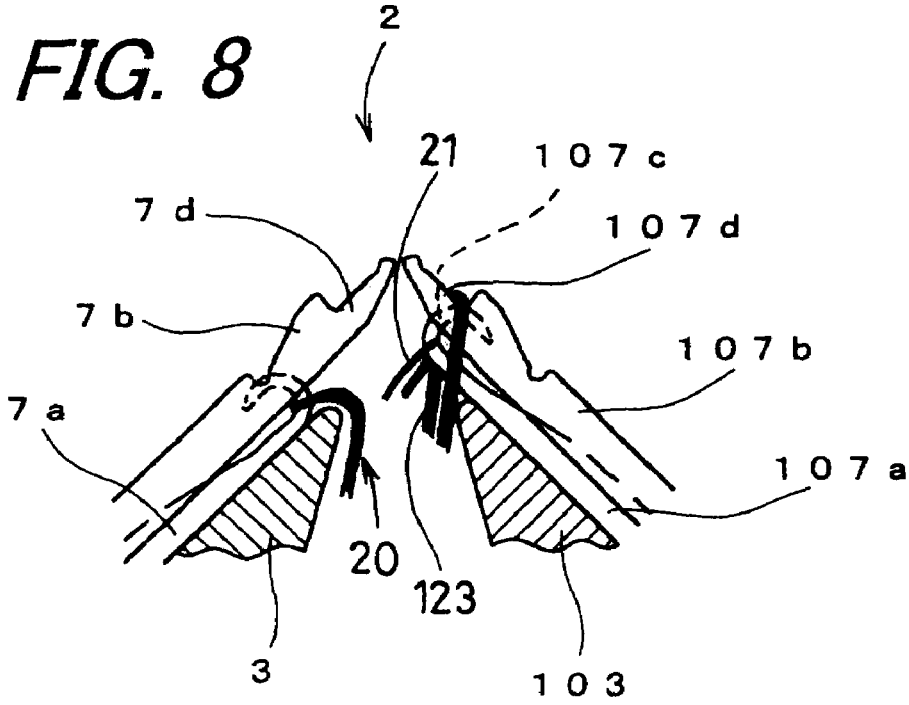
FIG. 8 is a sectional side view schematically showing the vicinity of the needle bed gap where a fastening yarn 21 is being pulled in, following FIG. 7.

Following FIG. 7, FIG. 8 shows a state of lowering and retracting the needle body 107*a* from the needle bed gap 2 whereby a fastening yarn 21 is being pulled in while the slider 107*b* remains in the current state. A stitch density of stitch cams provided on the knitting cam system of the knitting operating cam mechanism 9 is set, for example, so that a minimum amount of the fastening yarn 21 is pulled in, whereby the knock-over is prevented even when the slider 107*b* is located at a position higher than that of the hook 107*a*. For reasons described in relation to FIG. 3, the slider 7*b* on the front needle bed 3 is raised and advanced to the needle bed gap 2.

The fifth course is an empty course for which the carriage is made to move in a reverse direction to that for the fourth course.

Figure 9:
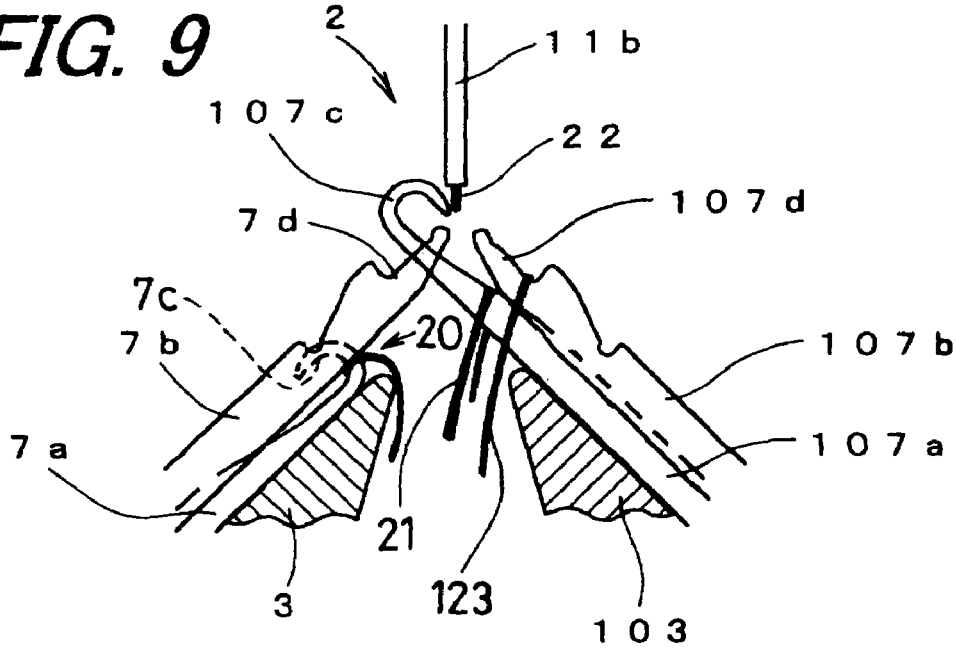
FIG. 9 is a sectional side view schematically showing the vicinity of the needle bed gap in a state where a hook 107*c* receives a pile yarn 22 as a sixth course in the pile knitting method according to one embodiment of the invention.

FIG. 9 shows a state of making the carriage move in the same direction as that for the fourth course and bringing together the yarn feeder 11*b* for feeding the pile yarn 22, whereby the hook 107*c* receives the pile yarn 22. On the rear needle bed 103, in a state where the old loop 123 is held on the tongue 107*d* of the slider 107*b*, the needle body 107*a* is raised to a tuck position. The hook 107*d* of the needle body 107*a* holds therein the fastening yarn 21. When the pile yarn 22 is fed from the yarn feeder 11*b* to the hook 107*c*, the hook 107*c* holds therein the fastening yarn 21 and the pile yarn 22. The pile yarn 22 is set also on the tongue 7*d* of the slider 7*b* on the front needle bed 103, which has already been raised and advanced into the needle bed gap 2.

Figure 10:
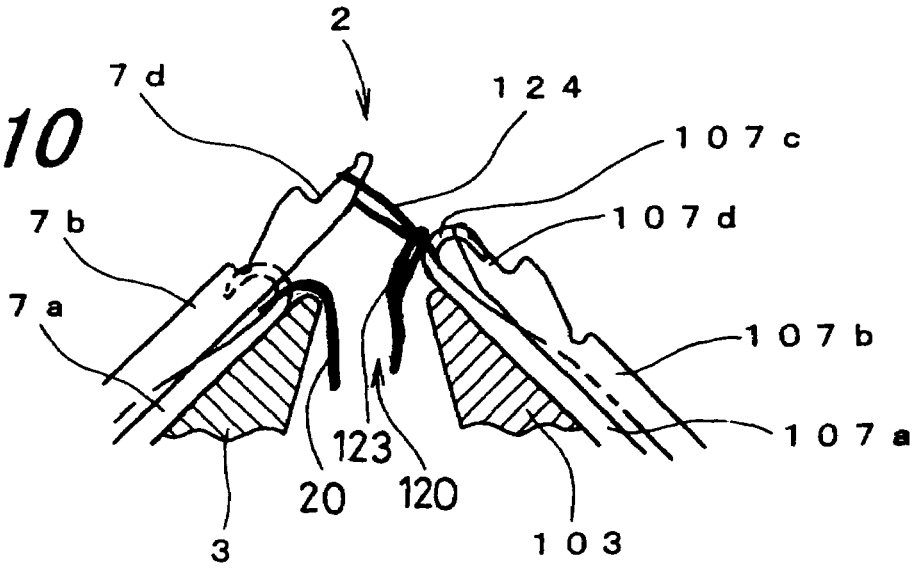
FIG. 10 is a sectional side view schematically showing the vicinity of the needle bed gap in a state where an old loop 123 is knocked over, following FIG. 9.

Following FIG. 9, FIG. 10 shows a state of lowering the needle body 107*a* and the slider 107*b* together to pull in on the rear needle bed 103, whereby the old loop 123 held on the tongue 107*d* of the slider 107*b* is knocked over. The pile yarn 22 set on the tongue 7*d* of the slider 7*b* on the front needle bed 3 is pulled out to form a pile stitch 124. The fabric 120 is held by the hook 107*c*.

Figure 11:
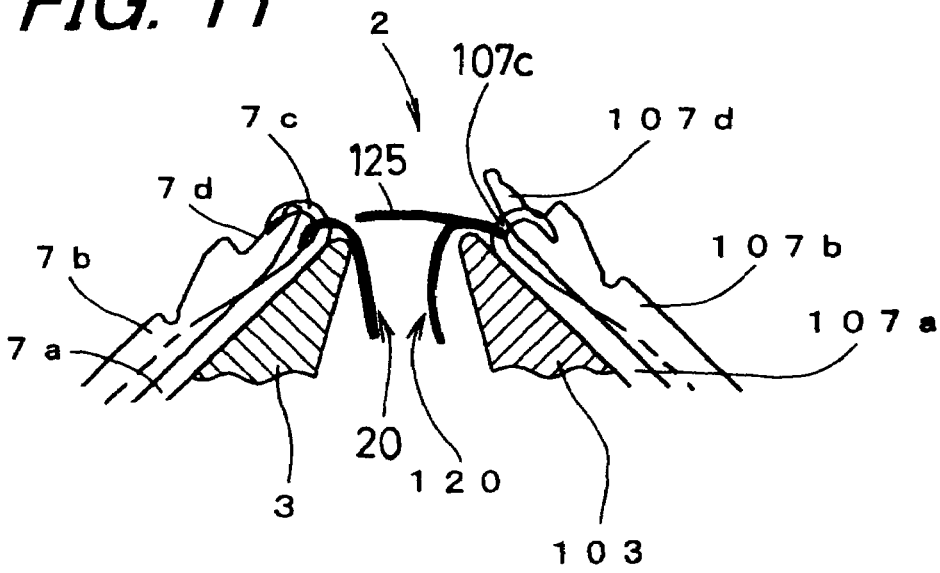
FIG. 11 is a sectional side view schematically showing the vicinity of the needle bed gap in a state where a slider 7*b* on a front needle bed 3 is lowered and retracted from a needle bed gap 2 so that a pile stitch 124 set on a tongue 7*d* is released at a beginning of a seventh course in the pile knitting method according to one embodiment of the invention.

FIG. 11 shows a state of lowering and retracting the slider 7*b* on the front needle bed 3 from the needle bed gap 2 at a beginning of a seventh course, whereby the pile stitch 124 set on the tongue 7*d* is released. The pile stitch 124 becomes a pile loop 125 which protrudes from a surface of the fabric 120 held on the rear needle bed 103. As in the case of FIG. 6, in order to press the pile loop 125 into the needle bed gap 2, the loop presser can be preferably used. A subsequent operation for the seventh course is the same as that shown in FIG. 2 and can be taken as a new first course. By thus repeating the formation of the pile loops 25 and 125 through the first course to sixth course, it is possible to knit a tubular pile fabric made of the fabrics 20 and 120, both ends of which are connected to each other. As described above, when the plurality of systems are provided on the knitting cam mounted on the carriage, it is possible to reduce the number of movement of the carriage.

As described above, when the pile stitch 24 is formed on the fabric 20 being knitted on the front needle bed 3 provided with the knitting needle 7, for example, the old loop 23 formed of the fastening yarn 21 and the pile yarn 21 is held on the knitting needle 7. In this state, the hook 7*c* is advanced to the needle bed gap 2, and the fastening yarn 21 for a new loop is fed to the hook 7*c*. The hook 7*c* to which the fastening yarn 21 has been fed is retracted from the needle bed gap 2 to thereby pull in the fastening yarn 21 in a range where the old loop 23 being held is not knocked over. In a state where only the fastening yarn 21 is held on the hook 7*c*, the hook 7*c* is advanced to the needle bed gap 2.

The pile yarn 22 is fed to the hook 7*c* and the tongue 107*d* of the slider 107*b* of the knitting needle 107 which is a compound needle on the rear needle bed 103 opposed to the needle bed 3. Since the fastening yarn 21 has been already fed into the hook 7*c*, not only the fastening yarn 21, but also the pile yarn 22 is held by the hook 7*c* of the knitting needle 7. The hook 7*c* of the knitting needle 7 is retracted from the needle bed gap 2 to pull the fastening yarn 21 and pile yarn 22 of the new loop into the old loop 23 held on the knitting needle so that the old loop 23 is knocked over.

Since the pile yarn 22 is set also on the tongue 107*d* of the slider 107*b* on the opposed needle bed 103, the pile yarn 22 is pulled out as the pile stitch 24. By retracting the slider 107*b* of the compound needle from the needle bed gap 2, the pile yarn 22 set on the tongue 107*d* of the slider 107*b* is released to thereby form the pile loop 25, with the result that the needle body 107*a* of the compound needle need not be used for formation of the pile loop 25 and therefore can hold other stitches.

Further, when both of the front and rear needle beds 3 and 103 are provided with the compound needles as the knitting needles 7 and 107, the fastening yarn 21 and the pile yarn 22 are respectively fed to the compound needles on the front and rear needle beds 3 and 103 so that it is possible to knit a tubular fabric made of the fabrics 20 and 120, both ends of which are connected to each other, and a fabric made of the fabrics 20 and 120, one end of which is connected each other. It is also possible to knit separate fabrics on the front and rear needle beds at the same time.

When forming the pile stitch 24 at least in a part of the fabric 20 being knitted on one needle bed, the fabric 120 being knitted on the other needle bed 103 is held on the hook 107*c* of the compound needle on the other needle bed and in such a state, the hook 107*c* is made to have been retracted from the needle bed gap 2. The slider 107*b* of the compound needle on the other needle bed is advanced to the needle bed gap 2 to thereby form the pile stitch 24 by use of the tongue 107*d* of the slider 107*b* and the compound needle of the one needle bed 3.

When forming the pile stitch 24 at least in a part of the fabric 20 being knitted on the other needle bed 103, the fabric 20 being knitted on the one needle bed 3 is held on the hook 7*c* of the compound needle on the one needle bed 3 and in such a state, the hook 7*c* is made to have been retracted from the needle bed gap 2. The slider 7*b* of the compound needle on the one needle bed is advanced to the needle bed gap 2 to thereby form the pile stitch 124 by use of the tongue 7*d* of the slider 7*b* and the compound needle of the other needle bed 103. Accordingly, the pile stitches 24 and 124 and the pile loops 25 and 125 can be formed in the tubular fabric.

Note that the compound needle may be used only on one of the front and rear needle beds. In this case, it is possible to form a pile stitch in a fabric being knitted on a needle bed opposed to a needle bed on which the compound needle is used. In other words, the weft knitting machine 1 provided with the compound needle at least on one of the opposed front and rear needles beds 3 and 103 between which the needle bed gap 2 lies, can knit the pile stitch by feeding the fastening yarn 21 and the pile yarn 22 to the needle bed gap 2. To the needle bed gap 2 are fed the fastening yarn 21 and the pile yarn 22, of which only the pile yarn 22 is set on the tongues 7*d* and 107*d* of the sliders 7*b* and 17*b* of the compound needles, and to the knitting needle provided on the needle bed opposed to the needle beds 3 and 103 provided with the compound needle are fed the fastening yarn 21 and the pile yarn 22 to thereby form the stitch.

When the sliders 7*b* and 107*b* of the compound needles having the set pile yarn 22 thereon is retracted from the needle bed gap 2, the pile yarn 22 is dropped and thus released from the tongues 7*d* and 107*d* of the sliders 7*b* and 107*b*. Since the pile yarn 22 is released from the compound needle, it is possible to form the pile loop stitch in the fabric being knitted on the needle bed provided with a knitting needle which is not a compound needle but a latch needle or the like. The needle bodies 7*a* and 107*a* of the compound needle are not used for formation of the pile stitch and therefore can hold other stitches when forming the pile stitch.

The invention may be embodied in other various forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to at least one embodiment of the invention, there is used a weft knitting machine having at least one of opposed front and rear needle beds between which a needle bed gap lies, the at least one of opposed front and rear needle beds which is provided with a compound needle composed of a slider and a needle body such that the slider can be advanced farther to the needle bed gap than a hook of the needle body can, and a fastening yarn and a pile yarn are fed to a knitting needle on a needle bed opposed to a needle bed provided with the compound needle across the needle bed gap so that a pile stitch can be formed.

When feeding the pile yarn to the knitting needle, the pile yarn is simultaneously set also on a tongue of the slider of the compound needle, and when feeding the fastening yarn to the knitting needle, the fastening yarn is not fed to the compound needle. By so doing, it is possible to form a stitch formed of the pile yarn and the fastening yarn so that only the pile stitch is held on the tongue of the slider of the compound needle.

When the slider of the compound needle having the pile yarn set thereon is retracted from the needle bed gap, the pile stitch is dropped and thus released from the tongue of the slider. Since the pile yarn is released from the compound needle by operation of the slider only, the needle body of the compound needle need not be used for formation of the pile stitch and can also hold other stitches when the pile stitch is being formed. Since the compound needle can be used not only for the formation of the pile stitch but also for formation of various stitches, it is possible to selectively conduct one of normal knitting and pile knitting according to need or at any given occasion so that multiple functions of the compound needle can be effectively exhibited.

Further, according to an embodiment of the invention, it is possible to securely press a pile loop into the needle bed gap by use of a loop presser.

Further, according to an embodiment of the invention, while a fabric is held by the hook of the needle body of the compound needle by use of the compound needles provided on the front and rear needle beds, the slider of the compound needle can be used to form the pile stitch at least in a part of the fabric held on the opposed needle bed.

Further, according to an embodiment of the invention, when forming the pile stitch in the fabric being knitted on the needle bed provided with the knitting needle, the pile yarn is made to be set on the tongue of the slider on the opposed needle bed and therefore can be formed into the pile stitch by retracting the hook of the knitting needle from the needle bed gap. The slider of the compound needle is retracted from the needle bed gap to thereby release the pile stitch set on the tongue of the slider so that the pile loop is formed, with the result that the needle body of the compound needle need not be used for formation of the pile stitch and therefore can hold other stitches.

What is claimed is:

1. A method of knitting pile fabric by a weft knitting machine including a compound needle whose slider is capable of advancing farther to a needle bed gap than a hook of a needle body, the compound needle being provided on at least one of opposed front and rear needle beds between which the needle bed gap lies, the method comprising:

feeding a fastening yarn and a pile yarn to a knitting needle on a needle bed, opposed to a needle bed provided with the compound needle across the needle bed gap, the feeding including, setting, when the pile yarn is fed to the knitting needle, the pile yarn also on a tongue of a slider of the compound needle, not feeding, when fastening yarn is fed to the knitting needle, the fastening yarn to the compound needle, forming stitches of the pile yarn and the fastening yarn so that only a pile stitch is held on the tongue of the slider of the compound needle, and forming a pile loop in a fabric being knitted by the knitting needle by retracting the slider of the compound needle from the needle bed gap and releasing the pile stitch from the tongue of the slider.

2. The method of claim 1, wherein each of the front and rear needle beds is provided with a compound needle as a knitting needle, and in the case of forming pile stitches at least in a part of a fabric being knitted on one needle bed, the pile stitches are formed using the tongue of the slider of the compound needle on another needle bed and the compound needle on the one needle bed while the hook is retracted from the needle bed gap and the slider of the compound needle of the other needle bed is advanced to the needle bed gap in a state where a fabric being knitted on the other needle bed is held on the hook of the compound needle on the other needle bed, and in the case of forming the pile stitch at least in a part of a fabric being knitted on the other needle bed, the pile stitches are formed using the tongue of the slider of the compound needle on the one needle bed and the compound needle on the other needle bed while the hook is retracted from the needle bed gap and the slider of the compound needle on the one needle bed is advanced to the needle bed gap in a state where a fabric being knitted on the one needle bed is held on the hook of the compound needle on the one needle bed.

3. The method of claim 1, further comprising in the case of forming pile stitches in the fabric being knitted on the needle bed provided with the knitting needle, advancing the hook of the knitting needle and feeding to the hook of the knitting needle the fastening yarn for a new loop, in a state where an old loop formed of the fastening yarn and the pile yarn is held on the knitting needle;

retracting the hook of the knitting needle from the needle bed gap and pulling in the fastening yarn in a range where the old loop held on the knitting needle is not knocked over;

advancing the hook of the knitting needle to the needle bed and feeding the pile yarn to the hook of the knitting needle and the tongue of the slider of the compound needle on a needle bed opposed to the needle bed in a state where only the fastening yarn is held on the hook;

knocking over the old loop by retracting the hook of the knitting needle from the needle bed gap so that the fastening yarn and pile yarn of the new loop are pulled by the hook into the old loop held on the knitting needle; and forming a pile loop by retracting the slider of the knitting needle from the needle bed gap and releasing the pile stitch set on the tongue of the slider.

4. The method of claim 1, wherein the pile loop formed by releasing the pile stitch from the tongue of the slider is pressed by a loop presser into the needle bed gap.

5. The method of claim 2, further comprising in the case of forming pile stitches in the fabric being knitted on the needle bed provided with the knitting needle, advancing the hook of the knitting needle and feeding to the hook of the knitting needle the fastening yarn for a new loop, in a state where an old loop formed of the fastening yarn and the pile yarn is held on the knitting needle;

retracting the hook of the knitting needle from the needle bed gap and pulling in the fastening yarn in a range where the old loop held on the knitting needle is not knocked over;

advancing the hook of the knitting needle to the needle bed and feeding the pile yarn to the hook of the knitting needle and the tongue of the slider of the compound needle on a needle bed opposed to the needle bed in a state where only the fastening yarn is held on the hook;

knocking over the old loop by retracting the hook of the knitting needle from the needle bed gap so that the fastening yarn and pile yarn of the new loop are pulled by the hook into the old loop held on the knitting needle; and forming a pile loop by retracting the slider of the knitting needle from the needle bed gap and releasing the pile stitch set on the tongue of the slider.

6. The method of claim 2, wherein the pile loop formed by releasing the pile stitch from the tongue of the slider is pressed by a loop presser into the needle bed gap.

7. The method of claim 3, wherein the pile loop formed by releasing the pile stitch from the tongue of the slider is pressed by a loop presser into the needle bed gap.

8. The method of claim 5, wherein the pile loop formed by releasing the pile stitch from the tongue of the slider is pressed by a loop presser into the needle bed gap.

* * * * *